US005415967A

United States Patent [19]

Sakashita et al.

[11] Patent Number: 5,415,967

[45] Date of Patent: May 16, 1995

[54] PROCESS FOR PRODUCING TONER

[75] Inventors: Kiichiro Sakashita, Tama; Masaki Uchiyama, Yokohama; Masami Fujimoto, Kawasaki; Kiyoshi Mizoe, Yokohama, all of Japan

[73] Assignee: Canon Kabushiki Kaisha, Tokyo, Japan

[21] Appl. No.: 45,227

[22] Filed: Apr. 13, 1993

[30] Foreign Application Priority Data

Apr. 14, 1992 [JP] Japan ..... 4-119534

[51] Int. Cl.[6] ..... G03G 9/00

[52] U.S. Cl. ..... 430/137

[58] Field of Search ..... 430/137, 106, 111, 109

[56] References Cited

U.S. PATENT DOCUMENTS 5,108,224 4/1992 Cabaniss et al. ..... 405/52
5,147,753 9/1992 Hikake ..... 430/137
5,202,213 4/1993 Nakahara et al. ..... 430/110

*Primary Examiner*—John Goodrow
*Attorney, Agent, or Firm*—Fitzpatrick, Cella, Harper & Scinto

[57] ABSTRACT

A process for producing a toner comprises the steps of mixing toner particles having a weight average particle diameter of from 2 to 15 μm, with an external additive to prepare a toner, and passing the resulting toner through a sieve. The sieve has a wire cloth of twill weave that satisfies the following condition:

$$0.052 \leqq d\ mm \leqq 0.208$$

$$100 \leqq W\ \mu m \leqq 180$$

$$7.9 \times 10^{-4} \leqq d\ mm\ /\ W\ \mu m \leqq 9.1 \times 10^{-4}$$

wherein d represents average diameter of the wire used in the sieve, and W represents an aperture size of the sieve.

8 Claims, 3 Drawing Sheets

TONER PRODUCTION FLOW SHEET

PROCESS FOR PRODUCING TONER

BACKGROUND OF THE INVENTION

1. Field of the invention

The present invention relates to a process for preparing a toner used in image forming processes such as electrophotography and electrostatic recording.

2. Related Background Art

As shown in FIG. 3, toners are commonly produced by melt-kneading a thermoplastic resin and a colorant as exemplified by a dye, a pigment or a magnetic powder to form a uniform dispersion, followed by the step of pulverizing a cooled kneaded product and optionally the step of classifying the pulverized product, to prepare a fine powder, i.e., toner particles, with a given particle diameter and particle size distribution. The toner particles are further mixed with an external additive such as an inorganic fine powder or an organic fine powder in order to improve properties such as fluidity, charge stability, lubricity and cleaning performance of toners so that stable image reproduction can be continued through the step of development, the step of transfer and the step of cleaning to remove untransferred toner from a photosensitive member, in copying machines. Toners are thus produced.

In these steps, however, coarse particles, melt-adhered coarse particles due to mechanical heat generation and reagglomerates caused by van der Waals force may be produced to cause clogging of fine gaps in a developing machine, or to cause various faulty images because of their presence as defectively charged particles. In order to remove such coarse particles and reagglomerates, the toner particles are passed through a sieve with an aperture size of, for example, 100 to 250 μm. An apparatus having a sieve includes, for example, a multiple Gyro sifter (trade name for a gyratory sifter), and its vibration method includes mechanical vibration and ultrasonic vibration.

Coarse particles and reagglomerates can be first removed by such a method. Under existing circumstances, however, there is room for some improvement in production stability and toner quality. For example, as a result of repeated use of sieves for a long period of time, wires that form a wire cloth may wear because of friction between the toner particles and the wire cloth of the sieve to make the aperture size large or to cause a break of wires to make it impossible to achieve what is intended. In particular, in the case of magnetic toners containing magnetic powder in toner particles or toners comprised of toner particles mixed with a very hard and highly abrasive inorganic fine powder or organic fine powder, the wires may wear great. In addition, in recent years, toner particles are apt to have a smaller particle size for the pursuit of more highly detailed image quality, where an increase in specific surface area of toner particles per unit weight results in an increase in the frequency of their contact with the wires of the wire cloth. If the diameter of the wires is made smaller in order to make aperture size smaller so that the coarse particles and reagglomerates can be effectively removed, the problem arises that wear of wires is hastened.

In order for toner particles and external additives to be effectively passed through sieves, the sieves are vibrated in various ways.

When, however, a conventional sieve with a wire cloth of plain weave is vibrated to allow toners to pass therethrough, the surfaces of toner particles tend to be deformed to cause changes in the state of dispersion of external additives in toners or the state of adhesion between external additives and toner particles, resulting in changes in charge performance and powder characteristics of toners to often cause a lowering of the properties of toners.

Hence, it is earnestly sought to provide a method by which toners can be efficiently treated after the step of external addition, without causing any lowering of the properties of toners.

SUMMARY OF THE INVENTION

An object of the present invention is to provide a process for producing a toner, that can stably achieve removal of agglomerates and coarse particles over a long period of time.

Another object of the present invention is to provide a process for producing a toner, that can prevent wear of the wire cloth of a sieve used for removing agglomerates and coarse particles.

Still another object of the present invention is to provide a process for producing a toner, that can make a toner retain the desired chargeability and powder characteristics in the step of removing agglomerates and coarse particles, to make it possible to obtain stable images.

A further object of the present invention is to provide a process for producing a toner, that may cause less damage of the wire cloth of a sieve even in the case of magnetic toners containing a magnetic material.

A still further object of the present invention is to provide a process for producing a toner, that may cause less damage of the wire cloth of a sieve even in the case of toners to which an inorganic fine powder or organic fine powder liable to abrade toner particles has been externally added.

A still further object of the present invention is to provide a process for producing a toner, that may cause less damage of the wire cloth of a sieve even in the case of toners having a small particle diameter.

The present invention provides a process for producing a toner, comprising the steps of mixing toner particles having a weight average particle diameter of from 2 to 15 μm, with an external additive to prepare a toner, and passing the resulting toner through a sieve having a wire cloth of twill weave that satisfies the following condition:

$$0.052 \leqq d\ mm \leqq 0.208$$

$$100 \leqq W\ \mu m \leqq 180$$

$$7.9 \times 10^{-4} \leqq d\ mm\ /\ W\ \mu m \leqq 9.1 \times 10^{-4}$$

wherein d represents average diameter of the wire used in the sieve, and W represents an aperture size of the sieve.

DESCRIPTION OF THE PREFERRED EMBODIMENTS

It has been common for the wire cloth of a twill weave to be used in sieves with fine wire cloth having an aperture size of 65 μm or less. As a result of studies made by the present inventors, however, they have discovered that a toner with a good electrophotographic performance can be produced in a good efficiency when a wire cloth of a twill weave having a wire cloth aperture size as large as 100 to 180 μm is used in the sieve, and thus have accomplished the present invention.

Figure 1A:
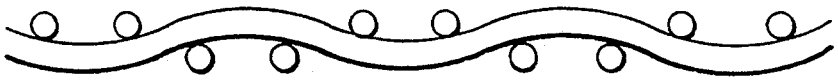
FIGS. 1A and 1B illustrate twill weaves.
Figure 1B:
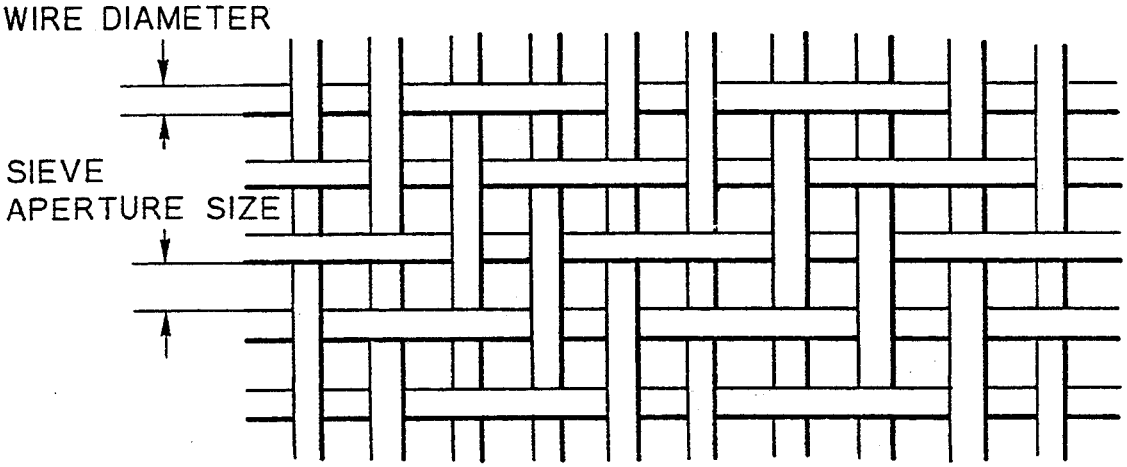
Figure 2A:
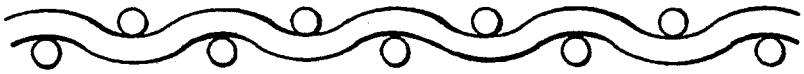
FIGS. 2A and 2B illustrate plain weaves.
Figure 2B:
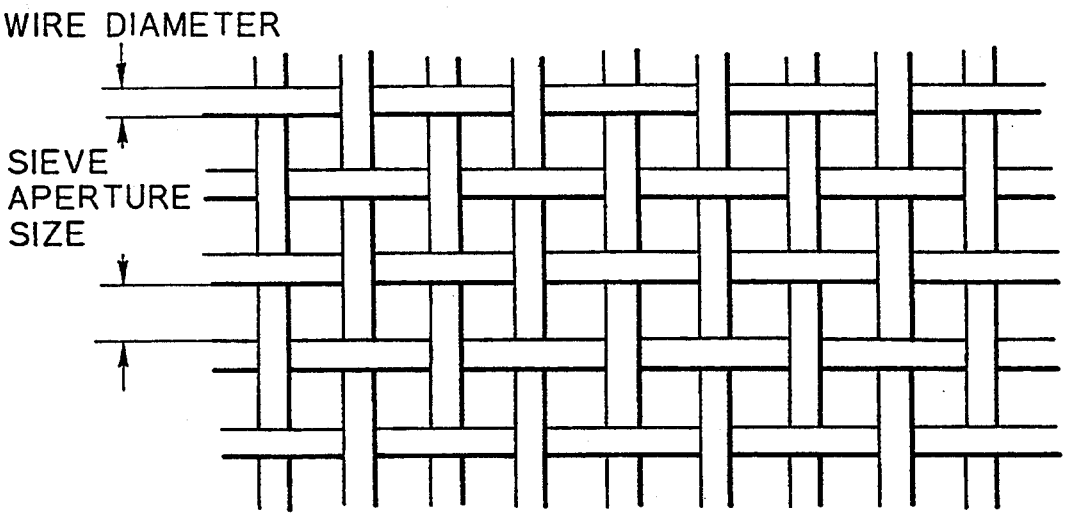
Figure 3:
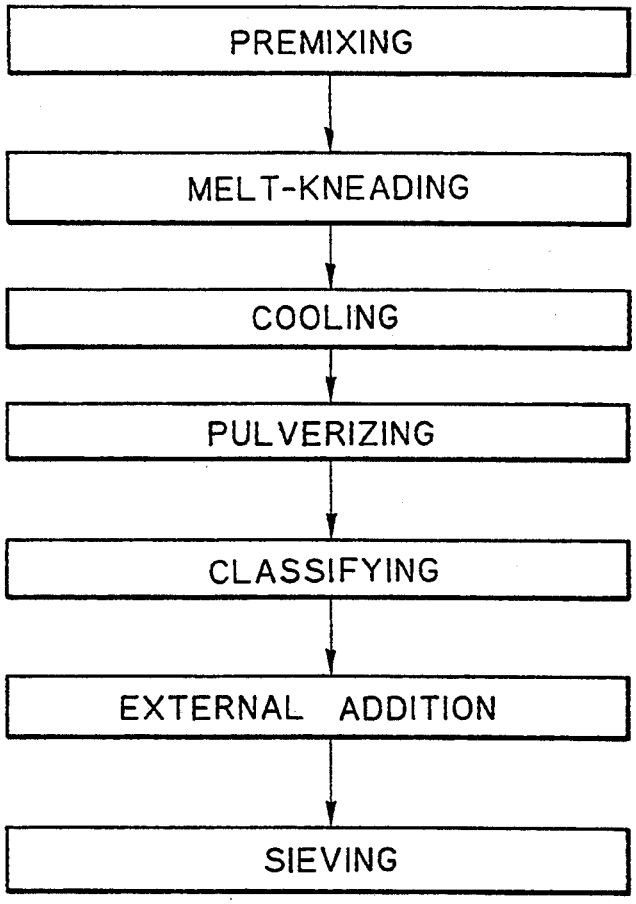
FIG. 3 is a flow sheet of toner production commonly carried out.

In the present invention, the toner particles are mixed with an external additive to form a toner composition, i.e., toner, and thereafter the toner is sieved. The sieve used has a wire cloth of twill weave as shown in FIG. 1. In the case of toner particles having a weight average particle diameter of from 2 to 15 μm, average diameter d of the wires constituting the wire cloth may preferably be from 0.052 to 0.208 mm, and average aperture size W of the wire cloth may preferably be from 100 to 180 μm. If the average diameter d is less than 0.052, the durability of the sieve tends to be poor. If on the other hand it is more than 0.208, the toner tends to stay at the seive too long. If the average aperture size W of the wire cloth is less than 100 μm, the external additive tends to become loose from toner particle surfaces. If on the other hand it is more than 180 μm, there is a large possibility that the coarse particles are included in the toner.

The average diameter d of the wires should preferably be from 0,080 to 0,180 mm, and the average aperture size W of the wire cloth from 106 to 170 μm.

The average diameter d of the wire cloth of the sieve is obtained by measuring diameters of at least five wires in the direction of longitudinal lines and at least five wires in the direction of lateral lines of the whole wire cloth, and calculating their average value. In that measurement, the wire cloth is magnified 100 times.

The average aperture size W of the wire cloth of the sieve is obtained in the following way: Lengths of at least five portions containing at least ten meshes, in the direction of longitudinal lines, are measured. From a value obtained by dividing the resulting length by the number of the meshes, the above average diameter d of the wire is subtracted to obtain values. Similarly, lengths of at least five portions containing at least ten meshes, in the direction of lateral lines, are measured. From a value obtained by dividing the resulting length by the number of the meshes, the above average diameter d of the wire is subtracted to obtain values. Then an average value of these values are calculated.

Materials for the wires may include metals and resins as exemplified by polyamide resins. In view of durability, metal wires made of stainless steel are preferred.

A value d/w of the sieve may preferably be from $7.9\times10^{-4}$ to $9.1\times10^{-4}$ and more preferably from $8.1\times10^{-4}$ to $9.1\times10^{-4}$ in view of the productivity of the toner and the quality of the toner.

The wire cloth of twill weave of the sieve used in the present invention has a structure comprised of, as shown in FIG. 1, rectangular meshes so combined as to form square apertures, so that the toner can be passed with ease without causing any changes in the state of addition of the external additive. Hence, the production process of the present invention can promise a good productivity of the toner, can have a good durability of the wire cloth of the sieve and can contribute superior electrophotographic performance of the toner.

On the other hand, in the case of the wire cloth of plain weave, it has only square meshes, so that the toner can not be passed through the wire cloth with ease, and in the passing, it is subject to changes in the state of addition of the external additive, and also the wipe cloth tends to be damaged by wear compared with the wire cloth of twill weave.

When the external additive is added to the toner particles, a powder mixing apparatus such as a Henschel mixer may preferably be used.

Apparatus provided with the sieve may include a vibrating screen and a Gyro sifter.

The distance the sieve moves in the horizontal direction may preferably be from 1 to 30 cm, and more preferably from 1 to 25 cm. The number of times of vibration (frequency) may preferably be from 50 to 500 times/min, and more preferably from 100 to 400 times/min.

The toner particles contain a binder resin, which is exemplified by the following.

Homopolymers or copolymers of vinyl monomers as shown below: Styrene; styrene derivatives such as o-methylstyrene, m-methylstyrene, p-methylstyrene, p-methoxystyrene, p-phenylstyrene, p-chlorostyrene, 3,4dichlorostyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate and vinyl benzoate; methacrylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acylamide; derivatives of vinyl compounds having a carboxyl group such as acrylic acid, methacrylic acid, maleic acid and fumaric acid; half esters such as maleic acid half ester and fumaric acid half ester; maleic acid anhydride, maleates, and fumarates.

The binder resin may further include polyesters, polyurethanes, epoxy resins, polyvinyl butyral, rosin, modified rosin, terpene resins, phenol resins, aliphatic or alicyclic hydrocarbon resins, aromatic petroleum resins, haloparaffins and paraffin waxes .

These polymers, resins or waxes are used alone or in the form of a mixture.

In particular, taking account of developing performance of the toner, styrene resins, acrylic resins and polyester resins can be particularly used as the preferred binder.

Taking account of anti-offset properties required for toners, the binder resin as described above may more preferably be a vinyl polymer or vinyl copolymer cross-linked with a cross-linking agent, or a mixture thereof.

Binder resins used for toners applied in a pressure fixing system may include low-molecular weight polyethylene, low-molecular weight polypropylene, an ethylene-vinyl acetate copolymer, an ethylene-acrylate copolymer, higher fatty acids, polyamide resins and polyester resins. These may preferably be used alone or in the form of a mixture.

In the case of a magnetic toner, magnetic materials for magnetic powder contained in magnetic toner particles may include iron oxides such as magnetite, maghematite and ferrite; iron oxides containing other metal compound; metals such as Fe, Co and Ni; alloys of any of these metals and any of metals such as Al, Co, Cu, Pb, Mg, Ni, Sn, Sb, Zn, Be, Bi, Cd, Ca, Mn, Se, Ti, W and V; and mixtures of any of these.

The magnetic material may have an average particle diameter of from 0.1 to 0.5 .m, and preferably from 0.1 to 0.3 μm, and may be contained in the magnetic toner in an amount of from 40 to 150 parts by weight based on 100 parts by weight of the resin component, and preferably from 60 to 120 parts by weight based on 100 parts by weight of the resin component.

In the case of a non-magnetic toner, any desired suitable pigment or dye is used as a colorant.

In order to improve triboelectric charge performance of the toner, a charge control agent may preferably be internally added to the toner. Known agents can be used as positive charge control agents. For example, Nigrosine and modified products thereof with a fatty acid metal salt, organic quaternary ammonium salts, diorganotin oxides and diorganotin borates can be used alone or in combination of two or more kinds. Of these, Nigrosine compounds and organic quaternary ammonium salts can particularly preferably be used.

Known agents can be used as negative charge control agents. For example, carboxylic acid derivatives and metal salts thereof, alkoxylates, organic metal complexes and chelate compounds can be used alone or in combination of two or more kinds. Of these, acetylacetone metal complexes, salicylic acid metal complexes, alkylsalicylic acid metal complexes, dialkylsalicylic acid metal complexes, naphthoic acid metal complexes and monoazo metal complexes can particularly preferably be used.

The toner particles should have a weight average particle diameter of from 2 to 15 μm, and preferably from 4 to 12 μm, in view of resolution and developability.

The weight average particle diameter of the toner particles is measured, for example, in the following manner.

Coulter counter Type TA-II (manufactured by Coulter Electronics, Inc.) is used as a measuring device. An interface (manufactured by Nikkaki k.k.) that outputs number average distribution and volume average distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured (number of particles: about 30,000 to about 300,000). The electrolytic solution in which the sample has been suspended is subjected to dispersion for about 1 minute to about 3 minutes using an ultrasonic dispersion device. The particle size distribution of particles of 2 μm to 40 μm is measured by means of the above Coulter counter Type TA-II, using an aperture of 100 μ as its aperture. Then a value of weight average particle diameter on the basis of weight determined from volume distribution is determined.

The additive (i.e. the external additive) mixed in the toner particles may include inorganic fine powders, surface-treated inorganic fine powders, and organic fine powders.

The inorganic fine powders may include fine powders of inorganic oxides and fine powders of carbonate compounds. The inorganic compounds may include alumina, zinc oxide, tin oxide, titanium oxide, and double oxides such as strontium titanate, barium titanate, calcium titanate, strontium zirconate and calcium zirconate. The carbonate compounds may include calcium carbonate and magnesium carbonate. Of these, fine powder of double oxides of titanium oxide, in particular, strontium titanate can bring about an excellent effect.

The external additive may preferably have a BET specific surface area of from 0.5 to 400 $m^2/g$, measured by nitrogen gas absorption.

Fine colloidal silica powder, hydrophobic fine colloidal silica powder, fine alumina powder, hydrophobic fine alumina powder, fine titanium powder and hydrophobic fine titanium powder having a BET specific surface area of from 40 to 400 $m^2/g$ are more preferred as the external additive in view of improvement in fluidity of the toner. Fine strontium titanate powder and cerium oxide are also preferred as abrasives and micro carriers of toner.

Use of two or more kinds of external additives in combination is also preferable in view of improvement of various properties of the toner.

Additives other than the foregoing may optionally be mixed. Such additives may include lubricants such as Teflon, polyvinylidene fluoride and fatty acid metal salts, abrasives such as silicon carbide, fluidity improvers or anti-caking agents, carbon black, and fixing aids such as low-molecular weight polyethylene. For the purpose of improving releasability when heat-roll fixing is carried out, a waxy substance such as low-molecular weight polyethylene, low-molecular weight polypropylene, microcrystalline wax, carnauba wax or sazole wax may also be added to the toner of the present invention in an amount of from 0.5 to 5% by weight.

In the production of the toner, it is preferable to use a method in which the toner component materials as described above are well mixed using a mixing machine and thereafter well kneaded using a heat kneading machine such as a heat roll kneader or an extruder, and the kneaded product is cooled to solidify, followed by pulverization, and classification of the pulverized product to give toner particles, which toner particles are mixed with the additives. Besides, it is possible to use a method in which the component materials are dispersed in a binder resin solution, followed by spray drying to give toner particles; and a method for producing toner particles by polymerization, in which given materials are mixed in monomers that constitute a binder resin to form an emulsified suspension, followed by polymerization. The toner particles according to the present invention may be microcapsule toner particles comprised of a core material and a shell material.

The present invention will be described below in detail by specifically giving Examples. The present invention is by no means limited to only these. In the following, "part(s)" refers to part(s) by weight.

EXAMPLE 1

| | |
|---|---|
| Styrene/butadiene resin | 100 parts |
| Magnetic iron oxide (average particle diameter: 0.2 μm) | 90 parts |
| Nigrosine dye | 2 parts |

The above materials were uniformly mixed using a Henschel mixer, and thereafter the mixture was melt-kneaded using a twin-screw extruder, followed by cooling. The resulting kneaded product was crushed to a size of about 100 μm to give a crushed product. The crushed product was pulverized using a jet pulverizer to give a pulverized product. The pulverized product was adjusted to have the desired particle size distribution, using a classifier. Thus a black fine powder "magnetic toner particles (A)" with a weight average particle diameter of 7 μm was obtained.

In a Henschel mixer with a capacity of 75 liters, 97.7% by weight of the magnetic toner particles (A), 0.3% by weight of hydrophobic fine colloidal silica powder and 2% by weight of fine strontium titanate powder were added, followed by mixing with stirring for 5 minutes at a stirring-blade revolution number of 1,800 rpm. Thus, magnetic toner (A) was obtained. The hydrophobic fine colloidal silica powder had a BET specific surface area of 200 $m^2/g$, and the fine strontium titanate had a BET specific surface area of 2.4 $m^2/g$.

In order to remove from the resulting magnetic toner particles (A) any melt-adhered matter, coarse particles, reagglomerates and so forth formed in the production steps, the magnetic toner (A) was passed through a sieve in a loading of 5 $kg/m^2/min$, using a Gyro sifter (whose sieve was made to gyrate at a gyratory radius of 30 mm and a gyration number of 230 rpm) provided with a sieve (120 meshes per linear inch) having a stainless steel wire cloth of twill weave with an average aperture size W of 112 μm, a wire average diameter d of 0.100 mm and a value d/W of $8.93\times10^{-4}$. Thus, magnetic toner (A-a) was obtained. Even after operation for 500 hours in total, no wire cloth of the sieve was damaged and no inclusion of coarse particles, melt-adhered matter and reagglomerates was seen in the magnetic toner (A-a).

The magnetic toner (A-a) having been passed through the sieve was put in a copying machine NP2020, manufactured by Canon Inc., to carry out image reproduction in an environment of normal temperature and normal humidity (temperature: 23° C.; humidity: 60%RH). As a result, the image density was 1.35 and none of faulty images such as fog and reversal fog were seen.

The copying machine having this magnetic toner 10 was left to stand overnight in an environment of high temperature and high humidity (temperature: 32.5° C.; humidity: 85%RH) and thereafter image reproduction was carried out in the environment of normal temperature and normal humidity. As a result, image reproduction on the 1st sheet was at an image density of 1.31, but at an image density restored to 1.35 on the 10th sheet.

Comparative Example 1

In the same manner as in Example 1, in a Henschel mixer with a capacity of 75 liters, 97.7% by weight of the magnetic toner particles (A), 0.3% by weight of hydrophobic fine colloidal silica powder and 2% by weight of fine strontium titanate powder were added, followed by mixing with stirring for 5 minutes at a stirring-blade revolution number of 1,800 rpm. Thus, magnetic toner (A) was obtained.

The magnetic toner (A) thus obtained was passed through a sieve in a loading of 5 $kg/m^2/min$, using a Gyro sifter provided with a sieve (120 meshes per linear inch) having a stainless steel wire cloth of plain weave with an average aperture size W of 125 μm, a wire average diameter d of 0.087 mm and a value d/W of $6.96\times10^{31\ 4}$. Thus, magnetic toner (A-b) was obtained. After operation for 50 hours in total, the wire cloth of the sieve was damaged by wear.

The magnetic toner (A-b) was put in a copying machine NP2020, manufactured by Canon Inc., to carry out image reproduction in the environment of normal temperature and normal humidity. As a result, the image density was 1.30.

The copying machine having this magnetic toner was left to stand overnight in the environment of high temperature and high humidity and thereafter image reproduction was carried out in the environment of normal temperature and normal humidity. As a result, image reproduction on the 1st sheet was at an image density of 1.15, at an image density of 1.20 on the 10th sheet, and at an image density only restored to 1.30 on the 50th sheet.

Comparative Example 2

The magnetic toner (A) having not been passed through a sieve was passed through a sieve in a loading of 5 $kg/m^2/min$, using a Gyro sifter provided with a sieve (140 meshes per linear inch) having a stainless steel wire cloth of plain weave with an average aperture size W of 111 μm, a wire average diameter d of 0.070 mm and a value d/W of $6.31\times10^4$. Thus, magnetic toner (A-c) was obtained. After operation for 30 hours in total, the wire cloth of the sieve was damaged by wear.

The magnetic toner (A-c) was put in a copying machine NP2020, manufactured by Canon Inc., to carry out image reproduction in the environment of normal temperature and normal humidity. As a result, the image density was 1.30.

The copying machine having this magnetic toner was left to stand overnight in the environment of high temperature and high humidity and thereafter image reproduction was carried out in the environment of normal temperature and normal humidity. As a result, image reproduction on the 1st sheet was at an image density of 1.20, at an image density of 1.25 on the 10th sheet, and at an image density only restored to 1.30 on the 50th sheet.

Example 2

| | |
|---|---|
| Styrene/n-butyl acrylate copolymer | 100 parts |
| Magnetic iron oxide (average particle diameter: 0.19 μm) | 60 parts |
| Nigrosine dye | 2 parts |
| Low-molecular weight wax | 5 parts |

The above materials were uniformly mixed using a Henschel mixer, and thereafter the mixture was melt-kneaded using a twin-screw extruder, followed by cooling. The resulting kneaded product was crushed to a size of about 100 μm to give a crushed product. The crushed product was pulverized using a jet pulverizer to give a pulverized product. The pulverized product was adjusted to have the desired particle size distribution, using a classifier. Thus a black fine powder "magnetic toner particles (B)" with a weight average particle diameter of 12 μm was obtained.

In a Henschel mixer with a capacity of 75 liters, 97.5% by weight of the magnetic toner particles (B), 0.5% by weight of hydrophobic fine colloidal silica powder and 2% by weight of fine cerium oxide powder with a BET specific surface area of 5 $m^2/g$, were added, followed by mixing with stirring for 5 minutes at a stirring-blade revolution number of 1,800 rpm. Thus, magnetic toner (B) was obtained.

In order to remove from the resulting magnetic toner particles (B) any melt-adhered matter, released matter, coarse particles, reagglomerates and so forth formed in the production steps, the magnetic toner (B) was passed through a sieve in a loading of 5 $kg/m^2/min$, using a Gyro sifter provided with a sieve (90 meshes per linear inch) having a stainless steel wire cloth of twill weave with an average aperture size W of 152 μm, a wire average diameter d of 0.13 mm and a value d/W of $8.55\times10^{-4}$. Thus, magnetic toner (B-a) was obtained. Even after operation for 500 hours in total, no wire cloth of the sieve was damaged and no inclusion of coarse particles, melt-adhered matter and reagglomerates was seen in the magnetic toner (B-a).

The magnetic toner (B-a) having been passed through the sieve was put in a copying machine NP2020, manufactured by Canon Inc., to carry out image reproduction in an environment of normal temperature and normal humidity (temperature: 23° C.; humidity: 60%RH). As a result, the image density was 1.30 and none of faulty images such as fog and reversal fog were seen.

The copying machine having this magnetic toner was left to stand overnight in an environment of high temperature and high humidity (temperature: 32.5° C.; humidity: 85%RH) and thereafter image reproduction was carried out in the environment of normal temperature and normal humidity. As a result, image reproduction on the 1st sheet was at an image density of 1.26, but at an image density restored to 1.30 on the 10th sheet.

Comparative Example 3

The magnetic toner (B) having not been passed through a sieve was passed through a sieve in a loading of 5 $kg/m^2/min$, using a Gyro sifter provided with a sieve (90 meshes per linear inch) having a stainless steel wire c10th of plain weave with an average aperture size W of 162 μm, a wire average diameter d of 0.120 mm and a value d/W of $7.4\times10^{-4}$. Thus, magnetic toner (B-b) was obtained. After operation for 90 hours in total, the wire c10th of the sieve was damaged by wear.

The magnetic toner (B-b) was put in a copying machine NP2020, manufactured by Canon Inc., to carry out image reproduction in the environment of normal temperature and normal humidity. As a result, the image density was 1.24.

The copying machine having this magnetic toner was left to stand overnight in the environment of high temperature and high humidity and thereafter image reproduction was carried out in the environment of normal temperature and normal humidity. As a result, image reproduction on the 1st sheet was at an image density of 1.15, at an image density of 1.20 on the 10th sheet, and at an image density only restored to 1.24 on the 50th sheet.

Comparative Example 4

The magnetic toner (B) having not been passed through a sieve was passed through a sieve in a loading of 5 $kg/m^2/min$, using a Gyro sifter provided with a sieve (90 meshes per linear inch) having a stainless steel wire cloth of twill weave with an average aperture size W of 132 μm, a wire average diameter d of 0.150 mm and a value d/W of $11.36\times10^{-4}$. Thus, magnetic toner (B-c) was obtained. After operation for 110 hours in total, the wire cloth of the sieve was damaged by wear.

The magnetic toner (B-c) was put in a copying machine NP2020, manufactured by Canon Inc., to carry out image reproduction in the environment of normal temperature and normal humidity. As a result, the image density was 1.20.

The copying machine having this magnetic toner was left to stand overnight in the environment of high temperature and high humidity and thereafter image reproduction was carried out in the environment of normal temperature and normal humidity. As a result, image reproduction on the 1st sheet was at an image density of 1.12, and at an image density only restored to 1.20 on the 50th sheet.

EXAMPLE 3

In a Henschel mixer, 99.7% by weight of the magnetic toner particles (B) prepared in Example 2 and 0.3% by weight of hydrophobic fine colloidal silica powder were mixed with stirring to give magnetic toner (C). The magnetic toner (C) thus obtained was passed through a sieve in a loading of 5 $kg/m^2/min$, using a Gyro sifter provided with a sieve (100 meshes per linear inch) having a stainless steel wire cloth of twill weave with an average aperture size W of 134 μm, a wire average diameter d of 0.120 mm and a value d/W of $8.96\times10^{-4}$. Thus, magnetic toner (C-a) was obtained. Even after operation for 500 hours in total, no wire cloth of the sieve was damaged and no inclusion of coarse particles, melt-adhered matter and reagglomerates was seen in the magnetic toner (C-a).

The magnetic toner (C-a) was put in a copying machine NP2020, manufactured by Canon Inc., to carry out image reproduction in an environment of normal temperature and normal humidity (temperature: 23° C.; humidity: 60%RH). As a result, the image density was 1.30 and none of faulty images such as fog and reversal fog were seen.

The copying machine having this magnetic toner was left to stand overnight in an environment of high temperature and high humidity (temperature: 32.5° C.; humidity: 85%RH) and thereafter image reproduction was carried out in the environment of normal temperature and normal humidity. As a result, image reproduction on the 1st sheet was at an image density of 1.23, but at an image density restored to 1.30 on the 10th sheet.

Comparative Example 5

The magnetic toner (C) prepared in Example 3 was passed through a sieve in a loading of 5 $kg/m^2/min$, using a Gyro sifter provided with a sieve (100 meshes per linear inch) having a stainless steel wire cloth of plain weave with an average aperture size W of 140 μm, a wire average diameter d of 0.114 mm and a value d/W of $8.14\times10^{-4}$. Thus, magnetic toner (C-b) was obtained.

The magnetic toner (C-b) was put in a copying machine NP2020, manufactured by Canon Inc., to carry out image reproduction in the environment of normal temperature and normal humidity. As a result, the image density was 1.27.

The copying machine having this magnetic toner was left to stand overnight in the environment of high temperature and high humidity and thereafter image reproduction was carried out in the environment of normal temperature and normal humidity. As a result, image reproduction on the 1st sheet was at an image density of 1.20, and at an image density only restored to 1.27 on the 50th sheet.

TABLE

| | Magnetic toner | Sieve: Type of cloth | d (mm) | W (μm) | d/W | Mesh | Durability of sieve (hours) | Magnetic* toner | Image density |
|---|---|---|---|---|---|---|---|---|---|
| Example: | | | | | | | | | |
| 1 | (A) | Twill weave | 0.100 | 112 | $8.93 \times 10^{-4}$ | 120 | >500 | (A-a) | 1.35 |
| 2 | (B) | Twill weave | 0.130 | 152 | $8.55 \times 10^{-4}$ | 90 | >500 | (B-a) | 1.30 |
| 3 | (C) | Twill weave | 0.120 | 134 | $8.96 \times 10^{-4}$ | 100 | >500 | (C-a) | 1.20 |
| Comparative Example: | | | | | | | | | |
| 1 | (A) | Plain weave | 0.087 | 125 | $6.96 \times 10^{-4}$ | 120 | 50 | (A-b) | 1.30 |
| 2 | (A) | Plain weave | 0.070 | 111 | $6.31 \times 10^{-4}$ | 140 | 30 | (A-c) | 1.30 |
| 3 | (B) | Plain weave | 0.120 | 162 | $7.41 \times 10^{-4}$ | 90 | 90 | (B-b) | 1.24 |
| 4 | (B) | Twill weave | 0.150 | 132 | $11.36 \times 10^{-4}$ | 90 | 110 | (B-c) | 1.20 |
| 5 | (C) | Plain weave | 0.114 | 140 | $8.14 \times 10^{-4}$ | 100 | | (C-b) | 1.27 |

*having been passed through the sieve

What is claimed is:

1. A process for producing a toner, comprising the steps of mixing toner particles having a weight average particle diameter of from 2 to 15 μm, with an external additive to prepare a toner, and passing the resulting toner through a sieve having a wire cloth of twill weave that satisfies the following condition:

$$0.052 \leqq d\ mm \leqq 0.208$$

$$100 \leqq W\ \mu m \leqq 180$$

$$7.9 \times 10^{-4} \leqq d\ mm\ /\ W\ \mu m \leqq 9.1 \times 10^{-4}$$

wherein d represents average diameter of the wire used in the sieve, and W represents an aperture size of the sieve.

2. The process according to claim 1, wherein said toner particles comprise magnetic toner particles and said external additive comprises an inorganic fine oxide powder.

3. The process according to claim 1, wherein said external additive comprises fine strontium titanate powder and fine colloidal silica powder.

4. The process according to claim 1, wherein said external additive comprises fine cerium oxide powder and fine colloidal silica powder.

5. The process according to claim 1, wherein said wire cloth comprises a metal wire or a resin wire.

6. The process according to claim 1, wherein said wire cloth comprises a stainless steel wire.

7. The process according to claim 1, wherein said wire cloth satisfy the following condition:

$$0.080 \leqq d mm \leqq 0.180$$

$$106 \leqq W\ \mu m \leqq 170$$

$$8.1 \times 10^{-4} \leqq d\ mm\ /\ W\ \mu m \leqq 9.1 \times 10^{-4}.$$

8. The process according to claim 1, wherein said toner is passed through a sieve being vibrated.

* * * * *

UNITED STATES PATENT AND TRADEMARK OFFICE

CERTIFICATE OF CORRECTION

PATENT NO. : 5,415,967

DATED : May 16, 1995

INVENTOR(S) : KIICHIRO SAKASHITA, ET AL.

It is certified that error appears in the above-identified patent and that said Letters Patent is hereby corrected as shown below:

COLUMN 1

Line 5, "invention" should read --Invention--.
Line 53, "great." should read --greatly.--.

COLUMN 3

Line 28, "0,080 to 0,180 mm," should read --0.080 to 0.180 mm,--.

COLUMN 4

Line 2, "wipe" should read --wire--.
Line 19, "Styrene;" should read --styrene;--.
Line 22, "3,4dichlorostyrene, p-ethylstyrenee," should read --3,4-dichlorostyrene, p-ethylstyrene,--.
Line 24, "tyelene," should read --tyrene,--.

COLUMN 5

Line 17, "0.5 .m," should read --0.5 μm,--.

COLUMN 7

Line 56, "10" should be deleted.

COLUMN 8

Line 12, "$6.96\times10^{31\ 4}$" should read --$6.96\times10^{-4}$--.
Line 37, "$6.31\times10^{4}$." should read --$6.31\times10^{-4}$.--.
Line 55, "Example 2" should read --EXAMPLE 2--.

UNITED STATES PATENT AND TRADEMARK OFFICE

CERTIFICATE OF CORRECTION

PATENT NO. : 5,415,967

DATED : May 16, 1995

INVENTOR(S) : KIICHIRO SAKASHITA, ET AL.

It is certified that error appears in the above-identified patent and that said Letters Patent is hereby corrected as shown below:

COLUMN 9

Line 50, "c10th" should read --cloth--.
Line 54, "c10th" should read --cloth--.

COLUMN 12

Line 32, "satisfy" should read --satisfies--.

Signed and Sealed this

Twenty-ninth Day of August, 1995

Bruce Lehman

*Attest:*

BRUCE LEHMAN

*Attesting Officer*

*Commissioner of Patents and Trademarks*